US009936313B2

(12) United States Patent
Westerkull

(10) Patent No.: US 9,936,313 B2
(45) Date of Patent: Apr. 3, 2018

(54) HEARING AID SYSTEM WITH POSITIONING TOOL

(71) Applicant: MED-EL Elektromedizinische Geraete GmbH, Innsbruck (AT)

(72) Inventor: Patrik Westerkull, Askim (SE)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 0 days.

(21) Appl. No.: 15/479,384

(22) Filed: Apr. 5, 2017

(65) Prior Publication Data

US 2017/0208404 A1 Jul. 20, 2017

Related U.S. Application Data

(63) Continuation of application No. 14/870,438, filed on Sep. 30, 2015, now Pat. No. 9,693,157.

(51) Int. Cl.
*H04R 25/00* (2006.01)

(52) U.S. Cl.
CPC ..... *H04R 25/608* (2013.01); *H04R 2225/021* (2013.01); *H04R 2460/17* (2013.01)

(58) Field of Classification Search
CPC ..... H04R 2460/17; A61M 35/003
USPC ..... 381/329
See application file for complete search history.

(56) References Cited

U.S. PATENT DOCUMENTS 4,281,659 A * 8/1981 Farrar ..... A61B 5/0448 204/403.02
9,031,274 B2 * 5/2015 Kasic, II ..... H04R 25/60 381/151
2006/0058714 A1 * 3/2006 Rhoades ..... A45D 24/007 601/73
2010/0298830 A1 * 11/2010 Browne ..... A61B 17/1615 606/79
2012/0101482 A1 * 4/2012 Flores ..... A61B 17/00 606/1
2015/0043766 A1 * 2/2015 Westerkull ..... C09J 133/08 381/322

FOREIGN PATENT DOCUMENTS

WO WO 2013066854 A1 * 5/2013 ..... A61B 5/6833

* cited by examiner

*Primary Examiner* — Matthew Eason
*Assistant Examiner* — Ryan Robinson
(74) *Attorney, Agent, or Firm* — Sunstein Kann Murphy & Timbers LLP

(57) ABSTRACT

A hearing aid attachment system includes a positioning tool and an interconnection unit. An upper surface of the interconnection unit has a second shape that matches a corresponding first shape of a cavity in the lower surface of the positioning tool so that the upper surface fits into the cavity with a second front surface of the positioning tool against and radially outside the front side of the interconnection unit, with the connection portion of the positioning tool connected to the connecting portion of the interconnection unit. The positioning tool is further configured to be removable from the interconnection unit without removing the interconnection unit from the skin.

1 Claim, 5 Drawing Sheets

HEARING AID SYSTEM WITH POSITIONING TOOL

This application is a continuation of co-pending U.S. patent application Ser. No. 14/870,438, filed Sep. 30, 2015, which is incorporated herein by reference in its entirety.

TECHNICAL FIELD

The present invention relates to a hearing aid system that includes a positioning tool.

BACKGROUND ART

A hearing aid may be attached behind the ear through an adhesive interconnection unit as described in for example US2015063616. The interconnection unit is adhesively attached to the skin behind the ear and the hearing aid can then be connected to the interconnection unit since there is a coupling between the hearing aid and the interconnection unit. The coupling allows the hearing aid to be snapped on and off from the interconnection unit without removing the interconnection unit from the skin. The interconnection unit can be changed at intervals suitable for the skin, for example once a week.

When adhering an interconnection unit to the skin behind the ear it is very important to find the right position before pressing the interconnection unit towards the skin to adhere it since it is both a stress to the skin to remove it from the skin and also the adhesive properties of most adhesives are reduced after removing it from the skin so that when trying to attach the same adhesive surface again would this would result in a poorer adhesion to the skin.

The interconnection unit should be adhered to hair free skin behind the ear since adhesion to a hairy area is usually poor. It is therefore important that the interconnection unit is not placed too far to the rear behind the ear since it would then be at least partly adhered to the hair baring area and the adhesion would be very poor. It is however also important that the interconnection unit does not touch the outer ear since this may be uncomfortable. The interconnection unit is usually quite flat so it will go under the main part of the outer ear so if it would be placed too close to the outer ear it would touch the outer ear in the outer ear fold behind the outer ear.

The position of the interconnection unit on the skin surface behind the ear decides also the position of the hearing aid in relation to the outer ear when the hearing aid is connected to the interconnection unit. The hearing aid must also not touch the outer ear since this may be uncomfortable and since this may also cause acoustic feedback. It is therefore very important that the interconnection unit is adhered to the skin behind the ear in a correct position so that the hearing aid does not touch the outer ear when the hearing aid is connected to the interconnection unit. Depending on the individual size and shape of the outer ear, it may be either the interconnection unit or the hearing aid that would be the most likely part of the hearing aid system to touch the outer ear.

The hairless skin area behind the ear is quite limited in size so the precision in the positioning of the interconnection unit has to be very accurate. At the same time it is difficult for the user to see behind the ear when adhering the interconnection unit even if a mirror is used.

The optimal position of the hearing aid and interconnection unit is close to the ear, but without any of the interconnection unit or the hearing aid touching the outer ear. It is a challenge to try to position the interconnection with the current hearing aid systems. There is a need for a more effective and user friendly adhesive hearing aid system that is reliable and does not have the drawbacks discussed above.

SUMMARY

The present invention provides an effective solution to the above-outlined problems of hearing aid systems that includes an adhesively attachable interconnection unit to connect the hearing aid to the skin behind the ear. More particularly, the hearing aid system of the present invention includes a positioning tool that can assist the user to find the right position. This hearing aid system with a positioning tool is a unique and important step forward to make this type of hearing aid systems more applicable and user friendly.

The hearing aid system of the present invention has an interconnection unit that has a first side with a first connection portion that has a circular geometry, and this circular geometry has a center axis. The first connection portion is positioned non-centrically on the first side and towards a rear end of the interconnection unit which is opposite to a front end of the interconnection unit. Opposite to the first side, the interconnection unit has also a second side with an adhesive surface.

The hearing aid system also includes a hearing aid having a third front surface and a second connection portion. The first connection portion can be removably connected to the second connection portion and the circular geometry of the first connection portion allows the hearing aid to be rotated around the center axis in relation to the interconnection unit when the hearing aid is connected to the interconnection unit. There is of course a friction in this rotation so that the hearing aid does not rotate freely, however the possibility to turn the hearing aid by hand in relation to the interconnection unit is valuable in fine tuning the position and orientation of the hearing aid and its microphones.

The positioning tool has a seat so that the interconnection unit can be placed in this seat and the interconnection unit can be connected to the positioning tool with the first side of the interconnection unit facing the positioning tool when the interconnection unit is connected to the positioning tool. The interconnection unit can be removably connected to the positioning tool. The positioning tool has a first front surface and also a grip to hold it with the fingers.

Furthermore, the positioning tool is designed so that the front end of the interconnection unit is oriented in the same direction as the first front surface when the interconnection unit is located in the seat of the positioning tool.

To use the components of the present invention, the interconnection unit is first placed in the positioning tool, and then by sensing when the positioning tool touches the outer ear, the correct position for the interconnection unit behind the outer ear is found. By pressing the positioning tool, the adhesive surface of the interconnection unit is pressed against the skin so that it adheres properly. The positioning tool is removed from the interconnection unit and then the hearing aid can be connected to the interconnection unit and the position of the hearing aid can be fine-tuned by turning it in relation to the interconnection unit.

Furthermore, the positioning tool may have a specific holder portion to which the first connection portion can be removably connected so that the first connection portion is in connection with the holder portion when the interconnection unit is located in the seat of the positioning tool. In this way, the first connection portion can be used both for connecting to the hearing aid and for connecting to the positioning tool.

In a preferred embodiment of the hearing aid system of the present invention, the distance from the first front surface of the positioning tool to the center axis when the interconnection unit is located in the seat of the positioning tool is greater than the distance from the third front surface of the hearing aid to the center axis when the first connection portion is connected to the second connection portion. In this way, a certain distance is ensured between the outer ear and the hearing aid unit as long as the positioning tool has been used to sense the right position behind the outer ear when adhering the interconnection unit to the skin behind the outer ear. The position of the hearing aid in relation to the ear is mainly be determined by the position of the interconnection unit on the skin behind the outer ear. In a preferred embodiment of the hearing aid system of the present invention, the positioning tool has a second front surface that is located at the same side of the positioning tool as the first front surface. The second front surface is at least partly following the curvature of the front end of the interconnection unit (this curvature is best seen from the axial direction when the interconnection unit is placed in the positioning tool), and the second front surface of the positioning tool is more distant from the center axis than the front end of the interconnection unit when the interconnection unit is located in the seat of the positioning tool. In this way, a certain distance is ensured between the outer ear and the interconnection unit when using the positioning tool to sense the right position behind the outer ear when adhering the interconnection unit to the skin behind the ear.

The hearing aid may specifically be a bone conduction hearing aid generating vibrations that are transmitted to the interconnection unit via the second connection portion. This type of device may specifically benefit from an efficient adhesive fixation and since the device includes a vibrator, it is also quite a big and heavy hearing aid so it is especially important to position it correctly. The bone conduction hearing aid may be an be an ear level bone conduction device where the microphones are mounted to the housing of the hearing aid and to avoid acoustic feedback there is a suspension system between the vibrator and the hearing aid housing to isolate the vibrations from the vibrator from the housing and the microphones to avoid acoustic feedback. This suspension system would be disturbed if a force is applied to the hearing aid housing and this would cause acoustic feedback and it is therefore very important that the hearing aid does not touch the outer ear since this would cause acoustic feedback.

The interconnection unit and the positioning tool may specifically be designed so that the holder portion is a female connection and that the second connection portion has a male portion that can be entered into the female holder portion to connect the interconnection unit to the positioning tool. This design results in a very efficient and practical design of the arrangement.

In a preferred embodiment of the hearing aid system of the present invention, the holder portion is flexible to connect to the first connection portion. This may be an important feature since the connection force between the positioning tool and the interconnection unit may not have to be as strong as the connection force between the hearing aid and the interconnection. The connection force between the positioning tool and the interconnection unit may only have to ensure that the interconnection unit does not fall off from the positioning tool when handling the components and attaching the interconnection unit to the skin and the positioning tool should then be easy to disconnect from the interconnection unit once the interconnection unit has been adhered to the skin. The connection force between the hearing aid and the interconnection unit should however preferably be stronger since it should be able to carry the weight of the hearing aid that may include, for example, batteries, and the hearing aid must not fall off due to physical exercise by the user.

In a preferred embodiment of the hearing aid system of the present invention, the positioning tool includes a flexible rubber material which may be an efficient way of creating a suitable positioning tool and specifically a suitable connection force of the holder portion.

In a preferred embodiment of the hearing aid system of the present invention, the positioning tool includes a rear edge opposite to the second front surface and where the rear edge is a shaving line template edge positioned at a distance from the center axis that is greater than the distance from the center axis to the rear end of the interconnection unit when the interconnection unit is connected to the positioning tool. In this way, the positioning tool can also be used as a template to mark what area behind the ear that needs to be hairless to ensure that the interconnection unit is attached to hairless skin. The positioning tool used as a template may show which hair baring area needs to be shaved to become hairless.

In a preferred embodiment of the hearing aid system, the hearing aid component is attached to a skin portion behind the ear of the user and the positioning has a front surface and a lower portion disposed below the grip portion. The lower portion has a cavity with a first shape and the cavity has a connecting portion inside. The interconnection unit has a lower adhesive surface and an upwardly extending connection portion and a second shape similar to the first shape so that the interconnection unit fits well into the cavity. The interconnection unit is placed in the cavity with the lower adhesive surface facing away from the positioning tool and the connection portion of the interconnection unit is connected to the connection portion of the positioning tool. A side of the positioning tool is abutting a portion of the ear and the positioning tool, with the interconnection unit disposed therein, is moved towards the skin portion behind the ear while permitting the front surface on the side of the positioning tool to slide along the outer tip portion of the ear to guide the positioning tool. The lower adhesive surface is adhered to the skin portion behind the ear of the user and then the positioning tool is removed from the interconnection unit without removing the interconnection unit from the skin portion, and then the positioning tool is removed from the interconnection unit. The positioning tool may have an outwardly extending lip portion at a bottom of the positioning tool so that the lip portion can slide along a rear surface of the ear. The lip portion step may abut against a skin fold defined between the ear and the skin portion.

The hearing aid unit has a connection portion that can be connected to the connection portion of the interconnection unit, and the hearing aid unit can be turned the relative to the interconnection unit while the hearing aid unit is connected to the interconnection unit. The hearing aid unit can be tilted relative to the interconnection unit to disconnect the hearing aid unit from the interconnection unit, preferably this is done while at the same time pressing the hearing aid unit towards the interconnection to ensure that the interconnection unit is not disconnected from the skin. The concept includes placing the interconnection unit and the hearing aid unit behind the ear so that neither the interconnection unit nor the hearing aid unit touches the ear. An alternative is also that the hearing aid unit can be connected to the positioning tool prior to connecting the hearing aid unit to the interconnection unit.

As described above, the hearing aid system of the present invention includes a unique combination of solutions and provides new solutions and several advantages to meet complex user requirements.

DETAILED DESCRIPTION

Figure 1:
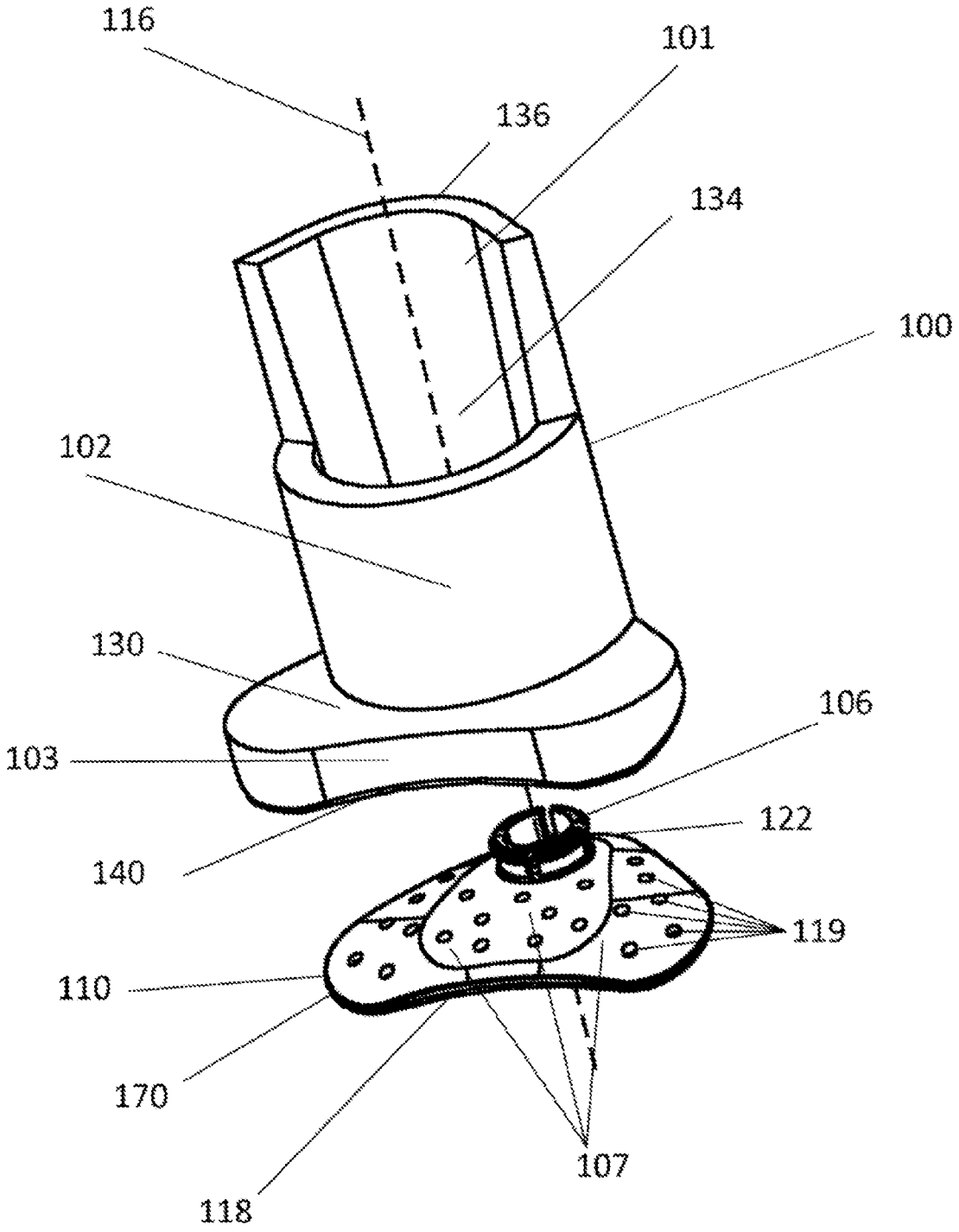
FIG. 1 is a perspective view of the positioning tool and the interconnection unit of the hearing aid system of the present invention.

FIG. 1 shows a perspective view of a positioning tool 100 and an interconnection unit 110 of the hearing aid system of the present invention. The positioning tool 100 has a first front surface 102 and an outwardly extending lip 130, disposed below the first front surface 102. The lip 130 has a second front surface 103. The positioning tool 100 has a grip portion 101. Preferably, the positioning tool 100 has an opening 134, including a central axis 116, extending from a holder portion 105 (best shown in FIG. 2) disposed inside the positioning tool to an upper end 136 of the positioning tool 100. The positioning tool 100 has a triangular-shaped cavity 138 (best shown in FIG. 2) defined therein at a bottom 140 of the tool 100. As described in detail below, the cavity 138 is adapted to receive the upper part of the interconnection unit 110, preferably, in a relatively tight fit so that the interconnection unit 110 may be inserted into the cavity 138 and held inside thereof by tool 100. The shape of cavity 138 is thus formed to substantially match the shape of the upper side of interconnection unit 110 so that peripheral edges 170 around unit 110 match and fit inside a peripheral rim 120 of unit 100 that surrounds cavity 138. The unit 110 is held to unit 100 by a connection portion 106 and holder portion 105, as described in detail below.

The interconnection unit 110 has the upwardly extending first connection portion 106 that has a circular geometry with a center axis 116. The first front surface 102 is located along the same side of the positioning tool 100 as the second front surface 103. The interconnection unit 110 has a first upper side 107 and a second lower side 108 (best shown in FIGS. 2-3) opposite to the first side 107. The interconnection unit 110 has holes 119 defined therein on the upper side 107 for moisture transportation. Preferably, the first connection portion 106 of the interconnection unit 110 is positioned closer to a rear end 122 opposite to a front side 118.

Figure 2:
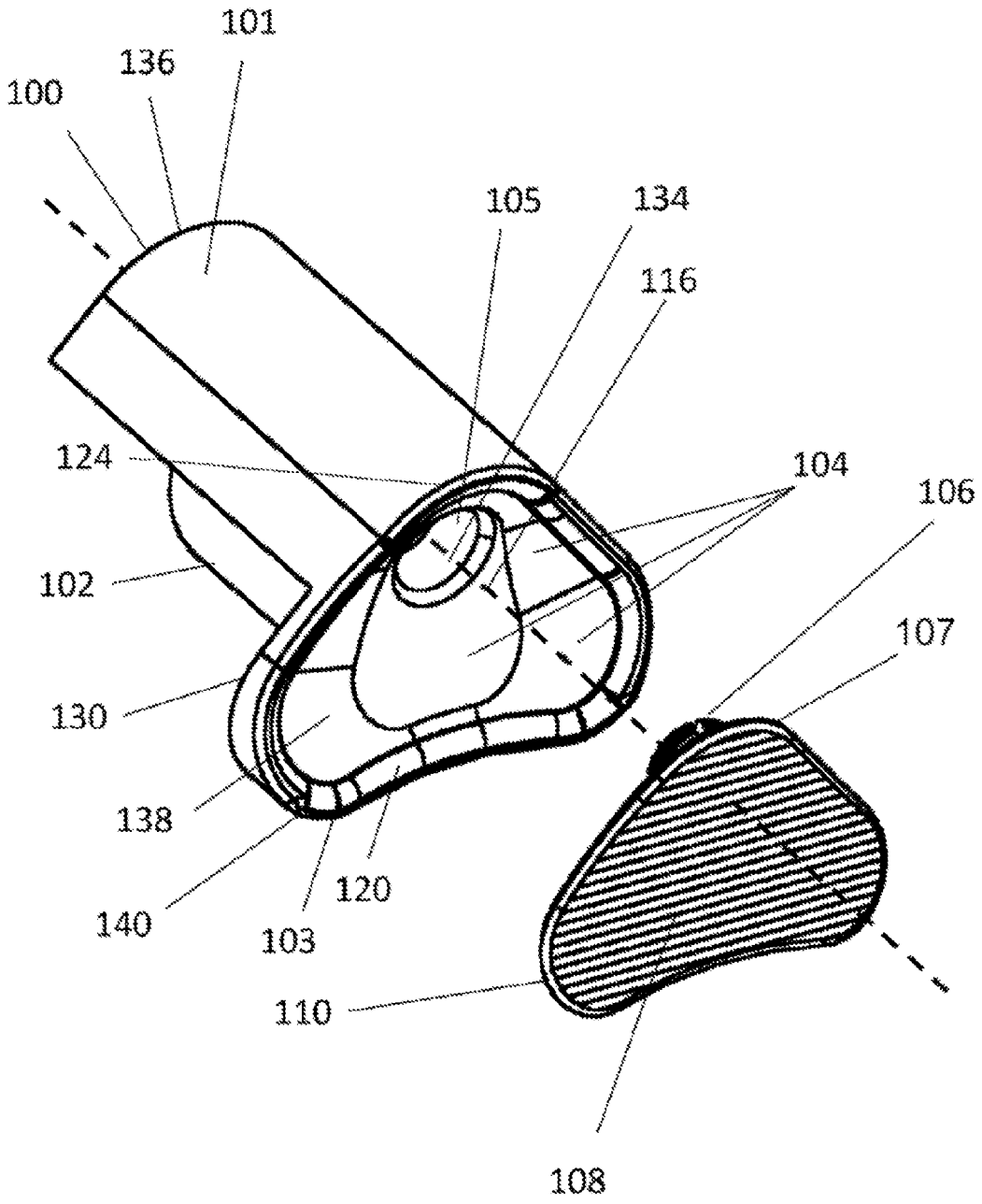
FIG. 2 is a perspective view of the embodiment shown in FIG. 1, shown from another angle.

FIG. 2 is a perspective view of positioning tool 100 and interconnection unit 110, as shown in FIG. 1 but shown from a different angle. The second side 108 of the interconnection unit 110 is an adhesive surface so that the interconnection unit 110 can be adhesively attached to the skin behind the ear of a user (see also FIGS. 4 and 5). As indicated above, the first connection portion 106 can be removably connected to the holder portion 105 of the positioning tool 100 by pressing the first connection portion 106 into the holder portion 105 until they are connected together by for example friction forces so that the interconnection unit 110 can be lifted up by the positioning tool 100 (see also FIG. 3). Preferably, holder portion 105 is flexible to connect in a gentle way to the connection portion 106. The positioning tool 100 has a seat 104, that forms the bottom of cavity 138, with rim 120 that has a shape that allows the front side 118 of the interconnection unit 110 to be oriented in the same direction (i.e. to the same side of the center axis 116) as the second front surface 103 when the first connection portion 106 is connected to the holder portion 105 and the interconnection unit 110 is seated in the seat 104 of the positioning tool 100. Another feature is that the connection force between first connection portion 106 and holder portion 105 may not be greater than the connection force that may be established between the adhesive surface 108 and the skin (see FIG. 4) so that tool 100 may simply be pulled off from interconnection unit 110 while unit 110 remains adhered to the skin.

The first front surface 102 may be located closer to the center axis 116 than the second front surface 103 when the positioning tool 100 is connected to the interconnection unit 110 since the interconnection unit 110 may be attached to the skin on the head under an outer ear (see also FIG. 4 and FIG. 5) and it is therefore important that the positioning tool 100 is adapted to this.

Figure 3:
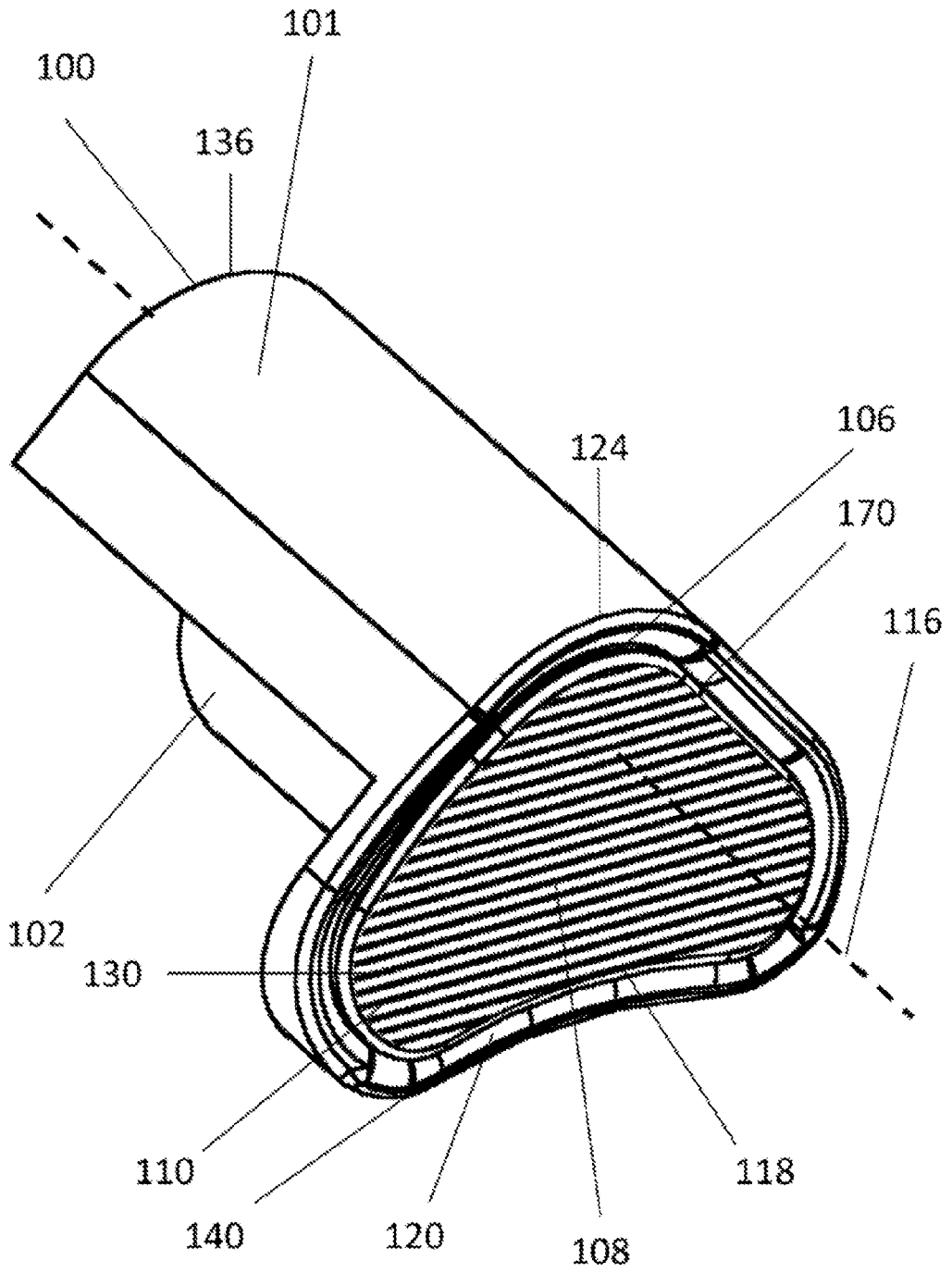
FIG. 3 is a perspective view of the embodiment shown in FIG. 2, where the interconnection unit has been seated in the positioning tool.

FIG. 3 is a perspective view of positioning tool 100 and interconnection unit 110, as shown in FIG. 2, but where the interconnection unit 110 is connected to the positioning tool 100. The second front surface 103 (best shown in FIG. 1) is further away from the center axis 116 than the front side 118 of the interconnection unit 110 when the interconnection unit 110 has been connected to the positioning tool 100 due to the rim 120. An important feature of the present invention is that the adhesive surface of side 108 extends beyond or is aligned with rim 120 when interconnection unit 110 is fully inserted into cavity 138 so that the adhesive surface of side 108 may conveniently be adhered to a skin surface (see FIG. 4) by urging side 108 against the skin while unit 110 is disposed inside tool 100.

Figure 4:
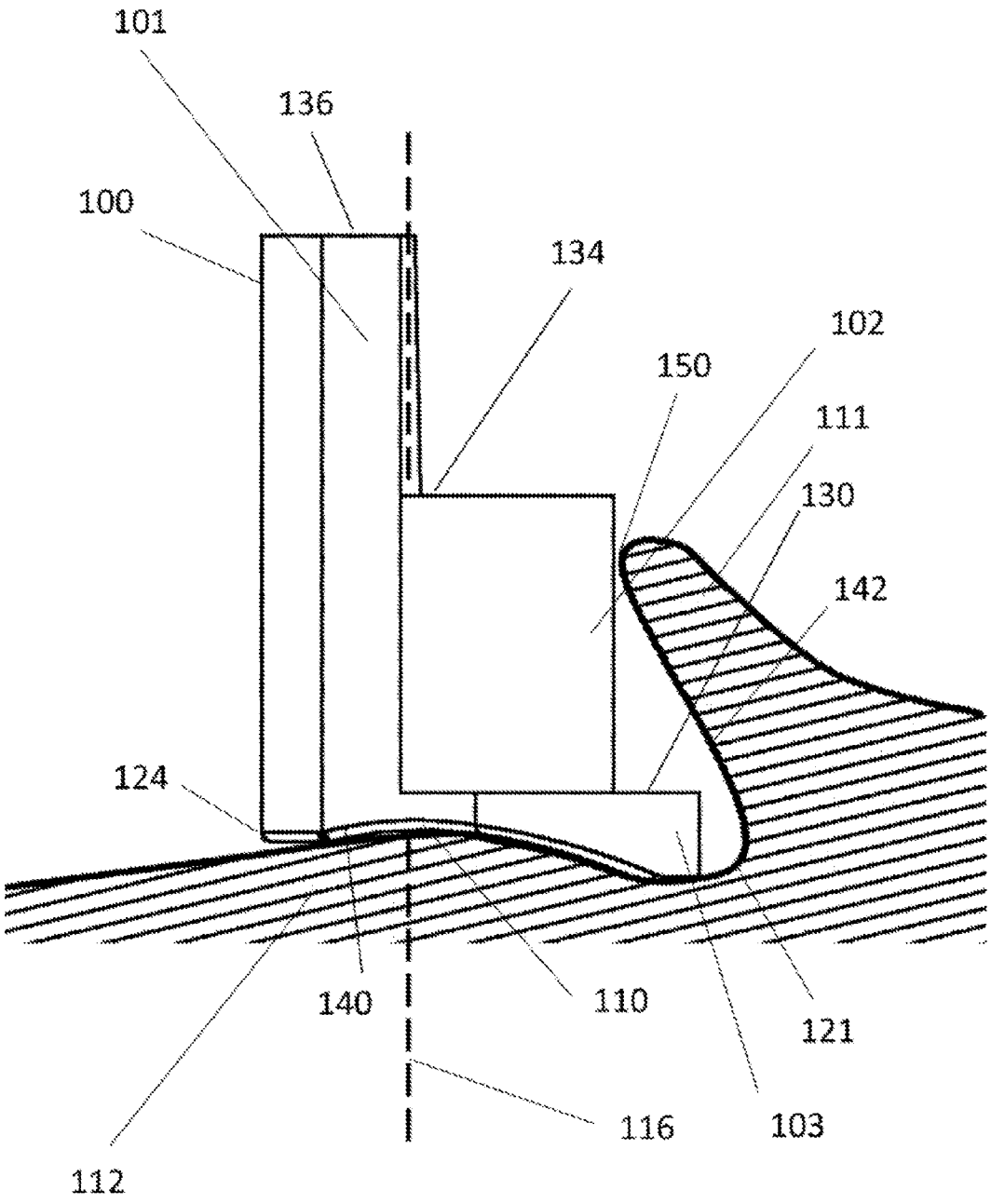
FIG. 4 is a perspective side view of the embodiment shown in FIG. 3, where the positioning tool and the interconnection unit is positioned behind the outer ear to adhere the interconnection unit to the skin in a correct position behind the outer. The ear is seen from a caudal view of the user.

FIG. 4 is a perspective view of positioning tool 100 and interconnection unit 110, as shown in FIG. 3, but shown when the adhesive surface of second side 108 (best shown in FIG. 5) is attached to a skin 112 on the head behind an outer ear 111 of a user. The skin fold 121 between the skin 112 on the head and the outer ear 111 is also marked. By sensing when either the first front surface 102 is touching and rear outer tip 150 of the outer ear 111 or when the second front surface 103 is touching the skin fold 121 disposed at a bottom of outer ear 111 where outer ear 111 meets skin 112 or when surface 103 touches a rear skin surface 142 (that extends between skin fold 121 and rear outer tip 150) below rear outer tip 150 of the outer ear 111, the positioning tool 100 helps the user to correctly position and attach the adhesive interconnection unit 110 on the skin in the desired position behind the outer ear 111. In the correct position behind the outer ear 111, the interconnection unit 110 must not touch the skin fold 121 or the outer ear 111 since this may cause discomfort. In the correct position of the interconnection unit 110 behind the outer ear 111 the hearing aid 113 (see FIG. 5) will also not touch the outer ear.

The user holds the positioning tool 100 with the connected interconnection unit 110 disposed inside cavity 138 and held therein by connection portion 106 and holder portion 105 and then finds the correct position behind the outer ear 111 by sensing when the positioning tool 100 touches either the skin fold 121 or the outer ear 111, and then the interconnection unit 110 is pressed against the skin 112 with the positioning tool 100 so that the adhesive surface of side 108 of interconnection unit 110 is adhesively attached to the skin 112. The seat 104 (see FIG. 2) is in contact with at least part of the first side 107 (see FIG. 1) of the interconnection unit 110 so that the interconnection unit 110 can be pressed against the skin 112 using the positioning tool 100 to properly adhere the adhesive surface of the second side 108 (not shown} to the skin 112.

The positioning tool 100 is then removed from the interconnection unit 110 so that the hearing aid 113 (see FIG. 5) can be attached to the interconnection unit 110. If the positioning tool is placed on skin 112, as shown in FIG. 4, it is also possible to use a rear edge 124 of the positioning tool 100 that is not facing the outer ear 111 as a template to draw a line with a pencil (not shown) on the skin 112 or on the hair (no shown) to mark the area of the skin 112 that needs to be hairless to be able to securely attach the adhesive second side 108 to hairless skin. In case the pencil mark would enter the hair baring area of the skin 112, the pencil mark would show the need for shaving of some hair behind the outer ear 111. In this way, the positioning tool 100 may also be used as a template for required shaving in case the naturally hairless area behind the outer ear 111 is too small to accommodate the interconnection unit 110 properly on an individual user.

Figure 5:
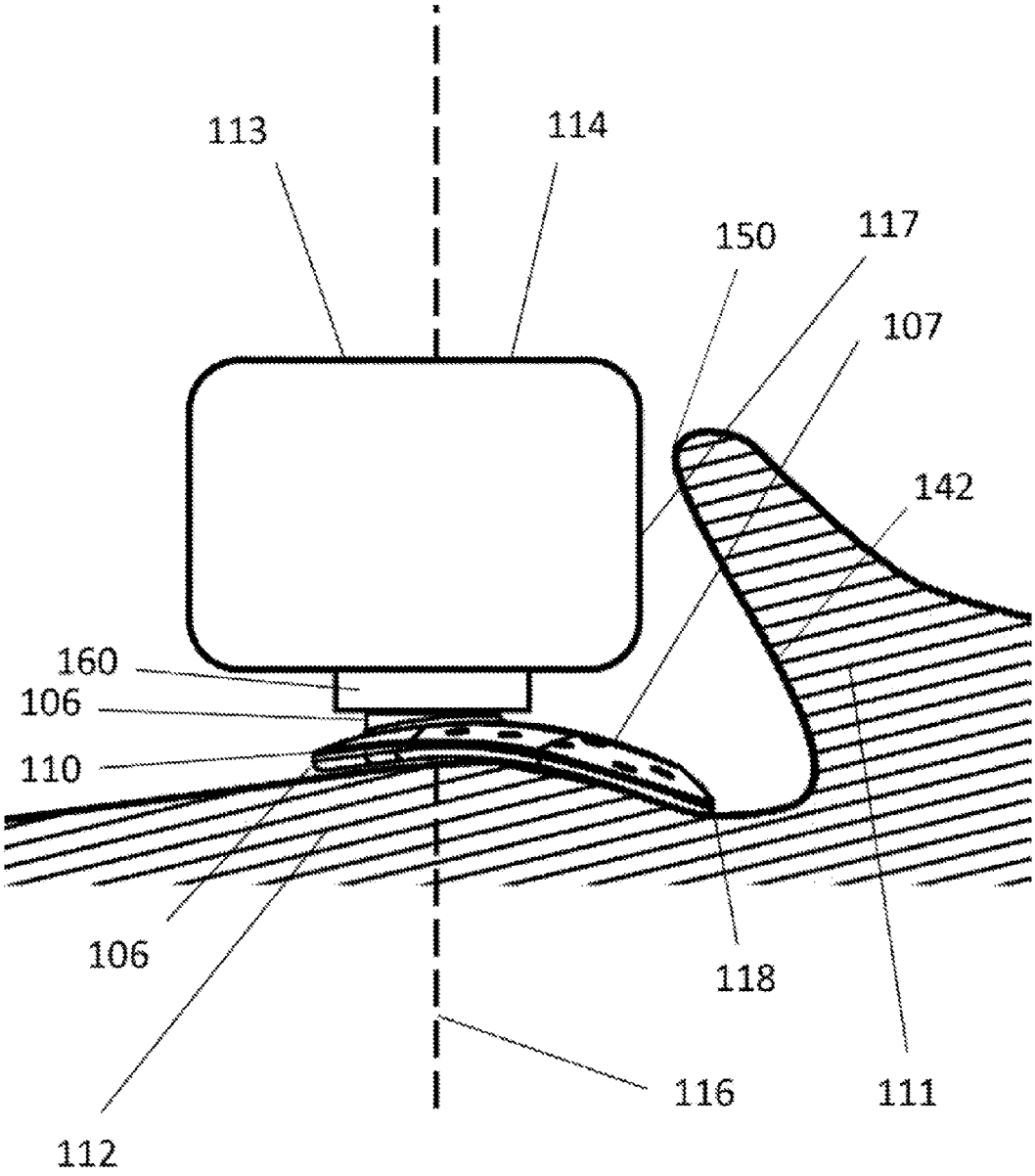
FIG. 5 is a perspective side view of the hearing aid and the interconnection unit of the hearing aid system of the present invention where the hearing aid is connected to the interconnection unit positioned in a correct position behind the outer ear seen from a caudal view of the user.

FIG. 5 is a perspective side view of the hearing aid 113, which is a bone conduction device transmitting sound to the inner ear with vibrations through the bone (not shown) when it is connected to the interconnection unit 110 (this is the same interconnection unit 110 as shown in FIG. 4) in its correct position on the skin 112. The hearing aid is an ear level bone conduction device where the microphones (not shown) are mounted to the housing 114 of the hearing aid 113, and to avoid acoustic feedback there is a suspension system (not shown) between the vibrator (not shown) and the hearing aid housing 114 to isolate the vibrations from the vibrator from the housing and the microphones to avoid acoustic feedback. The suspension system (not shown), the microphones (not shown) and the vibrator (not shown) are all located inside the hearing aid housing 114. The hearing aid 113 is connected to the first connection portion 106 of the interconnection unit 110.

The hearing aid 113 has a second connection portion 160 that allows it to be removably connected to the first connection portion 106. The vibrator (not shown) is firmly connected to the second connection portion 160 to transmit bone conduction vibrations to the user via the interconnection unit 110. The hearing aid 113 may be connected and disconnected several times from the interconnection unit 110 without removing the interconnection unit 110 from the skin 112. The hearing aid 113 can be turned around the center axis 116 in relation to the interconnection unit 110 since it can be turned around the circular connection portion 106 and this is useful to be able to fine-tune the position and orientation of the hearing aid 113 behind the outer ear 111.

The second connection portion 160 and the first connection portion 106 is preferably designed so that by pressing the hearing aid towards the interconnection unit 110 on the head and titling the hearing aid 113, the second connection portion 160 is disconnected from the first connection portion 106 and the hearing aid can be removed without removing the interconnection unit 110 from the skin 112. The interconnection unit 110 may be changed at intervals suitable for the skin 112 and depending on the adhesion between the second side 108 and the skin 112.

The hearing aid 113 has a third front surface 117 that is facing the outer ear 111 when the hearing aid 113 is worn. The distance from the first front surface 102 (see FIG. 4) to the center axis 116 (see FIG. 4) when the positioning tool 100 is connected to the interconnection unit 110 is greater than the distance between the third front surface 117 and the center axis 116 when the hearing aid 113 is connected to the interconnection unit 110. This is to ensure that the hearing aid 113 does not touch the outer ear 111 when it is connected to an interconnection unit 110 correctly positioned behind the outer ear 111.

The present invention offers unique new features since the interconnection unit 110 can be connected to both the positioning tool 100 and to the hearing aid 113, and that the connection to the hearing aid 113 allows for some rotation and that the connection to the positioning tool 100 ensures that the front end 118 of the interconnection unit 110 is oriented in the same direction as the first front surface 102 to ensure that the hearing aid 113 does not touch the outer ear 111 once it is connected to the correctly positioned interconnection unit 110 on the user. This allows the positioning tool 100 to facilitate a correct position and orientation of the interconnection unit 110 when adhering it to the skin 112 and at the same time allowing fine tuning of the hearing aid 113 orientation by rotating it in relation to the interconnection unit 110 when it is worn on the head of a user. It was surprising to find out how valuable the present invention is by providing a significant improvement of adhesively attachable hearing aid systems. The big improvement offered by the present invention was unexpected and it certainly is a big step forward. The different design features interacted in a unique and user friendly way.

With the new hearing aid system of the present invention, the new unique method offers a practical, efficient and user-friendly new hearing aid system that secures the quality of the treatment when it comes to avoiding the risk for acoustic feedback, improving the wearing comfort and making the hearing aid system straightforward and easy to use.

To use the hearing aid system of the present invention, the positioning tool 100 is used with the interconnection unit 110 that is then used with the hearing aid 113. The interconnection unit 110 is connected to the positioning tool 100 by placing the interconnection unit 110 in the seat 104 with the adhesive second side 108 facing away from the positioning tool 100, and the front end 118 of the interconnection unit 110 is oriented towards the same side of the positioning tool 100 as the first front surface 102.

The connection force between the interconnection unit 110 and the positioning tool 100 may be quite low and just have to ensure that the relatively light (preferably with a weight less than 2 gram) interconnection unit 110 does not fall off the positioning tool 100 during handling i.e. when the user places the positioning tool 100 with the interconnection unit 110 disposed or held inside the positioning tool 100, as described below. Alternatively it would also be possible insert an elongate object (not shown) through the opening 134 to keep the interconnection unit 110 in place on the skin 112 while removing the positioning tool 100 from the interconnection unit 110, and this would enable a higher connection force between the interconnection unit 110 and the positioning tool 100 to be chosen.

The interconnection unit 110 is thus held with the positioning tool 100 at the surface of the skin 112 behind the outer ear 111 so that the adhesive second surface 108 is held slightly above the surface of the skin 112 or in very light contact with the skin 112 so that the adhesive second side 108 can be moved sideways along the surface of the skin 112 without fixating side 108 to the skin 112.

The positioning tool 100, with the interconnection unit 110 disposed therein, is moved behind the ear 112 towards the outer ear 111 to find a position behind the outer ear 111 where the second front surface 102 lightly touches the rear outer tip 150 by the user sensing when the first front surface 102 of the positioning tool 100 is in contact with the rear outer tip 150. Depending upon the exact configuration of the back side of outer ear 111, it is also possible that surface 103 abuts skin fold 121 or the rear surface 142 prior to first front surface 102 abutting the rear outer tip 150. It is important that the user determines when either first front surface 102 touches rear outer tip 150 of outer ear 111 or when second front surface 103 touches skin fold 121 or the rear surface 142. Whatever of the above that positioning tool 100 abuts first helps the user to correctly position and attach the adhesive interconnection unit 110 on the skin 112 in the desired position behind the outer ear 111.

The adhesive second side 108 of the interconnection unit 110 is then attached to the skin 112 by pressing the second side 108 against the skin 112 i.e. by pressing the positioning tool 100 against the interconnection unit 110. Thereafter, the positioning tool 100 is removed from the interconnection unit 110 without removing the interconnection unit 110 from the skin 112, and this may be done by pulling the positioning tool 100 straight off from the interconnection unit 110 so that connection portion 106 is disengaged from holder portion 105.

The hearing aid 113 with the second connection portion 160 is now connected to the first connection portion 106 of the interconnection unit 110 by snapping it on to the first connection portion 106. The hearing aid 113 has a third front surface 117 that is less distant to the center axis 116 when the hearing aid 113 connected to the interconnection unit 110 than the first front surface 102 of the positioning tool 100 when the interconnection unit 110 is connected to the positioning tool 100, and since the interconnection unit 110 was adhered to the skin 112 using the positioning tool 100 there will be a gap between the third front surface 117 and the rear outer tip 150, i.e. the hearing aid 113 will not touch the outer ear 111.

The second connection portion 106 can be turned in relation to the first connection 105 around the center axis so that the orientation of the hearing aid 113 in relation to the outer ear 111 may be adjusted somewhat without disconnecting the interconnection unit 110 from the skin 112. The hearing aid 113 can now be used to stimulate the hearing organ (not shown) of the user. The hearing aid 113 may, for example, be a bone conduction hearing aid that transmits bone conduction vibrations via the interconnection unit 110 to the user.

The connection force between the second connection portion 160 and the first connection portion 106 may be much higher than the connection force between the interconnection unit 110 and the positioning tool 100 because the hearing aid 113 must not fall off easily from the user.

The hearing aid 113 can be removed from the interconnection unit 110 without removing the interconnection unit 110 from the skin 112. The first connection portion 106 and the second connection portion 160 are designed to form a snap coupling so that the hearing aid 113 can be disconnected from the interconnection unit 110 by tilting the hearing aid 113 in relation to the interconnection unit 110 and at the same time pressing the hearing aid 113 towards the interconnection unit 110 to ensure that the interconnection unit 110 is not removed from the skin 112 when disconnecting the hearing aid 113 from the interconnection unit 110. The hearing aid 113 can be connected and disconnected several times from the interconnection unit 110 without removing the interconnection unit 110 from the skin 112.

Preferably, the positioning tool 100 has the second front surface 103 located on the same side of the positioning tool 100 as the first front surface 102. Furthermore, the interconnection unit 110 has the front end 118 located at a shorter distance from the center axis 116 than the second front surface 103 when the interconnection unit 110 is positioned in the seat 104 of the positioning tool 100. The positioning tool 100, with the interconnection unit 110 disposed therein, is with this method moved behind the outer ear 111 as described above to attach the interconnection unit 110 in a correct position behind the outer ear 111. In this way, it is ensured that neither the interconnection unit nor the hearing aid, when they are finally and properly mounted behind outer ear 111, touches the outer ear to cause discomfort, acoustic feedback or other problems once the hearing aid 113 is attached to the interconnection unit 110.

The hearing aid system of the present invention may also be designed so that the interconnection unit 110 may be connected to both the hearing aid 113 and the positioning tool 100 at the same time. Either the hearing aid 113 may be connected to the interconnection unit 110 first and then the interconnection unit 110 is placed in the seat 104 of the positioning tool 100, or alternatively the interconnection unit 110 is positioned in the seat 104 of the positioning tool 100 first and then the hearing aid 113 is connected to the interconnection unit 110. The positioning tool 100 may then be removed from the interconnection unit 110 so that the hearing aid 113 and the interconnection unit 110 can be used without the positioning tool 100. It is also possible to design the bottom cavity 138 of the positioning tool 100 so that is matches a shape of the top of the hearing aid 113 so that the positioning tool 100 may be used to together place the hearing aid 113, with the interconnection unit 110 attached thereto, onto the skin portion behind ear 111. In other words, the hearing aid 113 is snapped onto the interconnection unit 110 and the positioning tool 100 is then mounted on top of the hearing aid 113 before the tool 100 is used to guide, such as by abutting the outer tip 150, the user to place the interconnection unit 110 behind the ear 111 in a manner that is similar to the manner described above i.e. by adhering a bottom surface 108 of unit 110 to the bare skin area behind the ear 111.

For all of the above embodiments several alternative designs and combinations are possible and the invention is not limited to the preferred embodiments presented above. While the present invention has been described in accordance with preferred compositions and embodiments, it is to be understood that certain substitutions and alterations may be made thereto without departing from the spirit and scope of the following claims.

What is claimed is:

1. A hearing aid attachment system, comprising:

a positioning tool made of flexible rubber material and having a central axis with:

a. an upper end having a grip portion, b. a lower end having a cavity with a first shape, the cavity containing a connecting portion, c. a first front surface radially outward from the central axis, and d. a second front surface radially outward from the first front surface; and an interconnection unit having:

a. a lower surface configured for adhesive attachment to skin behind an ear of a user, and b. an opposing upper surface with a front side and an upwardly extending connection portion, wherein the positioning tool and the interconnection unit are configured to cooperate when placing the interconnection unit on the skin behind the ear, including that the upper surface of the interconnection unit has a second shape matching the first shape of the cavity so that the upper surface fits into the cavity with the second front surface of the positioning tool against and radially outside the front side of the interconnection unit, with the connection portion of the positioning tool connected to the connecting portion of the interconnection unit; and wherein the positioning tool is configured to be removable from the interconnection unit without removing the interconnection unit from the skin.

* * * * *